US007318321B2

(12) United States Patent
Grassmuck et al.

(10) Patent No.: US 7,318,321 B2
(45) Date of Patent: Jan. 15, 2008

(54) OPEN-FRONT, ROLL-IN REFRIGERATED DISPLAY CASE

(75) Inventors: Michael D. Grassmuck, Chesterfield, MO (US); Martin J. Duffy, Edina, MN (US); John D. Withouse, Bland, MO (US); Dennis L. Dickerson, O'Fallon, MO (US); Aaron Hernandez, General Escobedo (NL)

(73) Assignee: Hussmann Corporation, Bridgeton, MO (US)

( * ) Notice: Subject to any disclaimer, the term of this patent is extended or adjusted under 35 U.S.C. 154(b) by 218 days.

(21) Appl. No.: 11/136,105

(22) Filed: May 24, 2005

(65) Prior Publication Data

US 2005/0257548 A1 Nov. 24, 2005

Related U.S. Application Data

(60) Provisional application No. 60/573,809, filed on May 24, 2004.

(51) Int. Cl.
*A47F 3/04* (2006.01)

(52) U.S. Cl. ..... 62/255; 312/116

(58) Field of Classification Search ..... 62/255–256; 312/116

See application file for complete search history.

(56) References Cited

U.S. PATENT DOCUMENTS

| | | | | |
|---|---|---|---|---|
| 2,506,448 | A | | 5/1950 | Gregor |
| 3,392,543 | A | | 7/1968 | Miller |
| 3,478,535 | A | | 11/1969 | Perez et al. |
| 3,690,118 | A | | 9/1972 | Rainwater |
| 3,719,408 | A | | 3/1973 | Fullington et al. |
| 3,902,613 | A | * | 9/1975 | Newland ..... 414/538 |
| 3,933,258 | A | | 1/1976 | Forsyth et al. |
| 4,023,378 | A | | 5/1977 | Kennedy et al. |
| 4,034,572 | A | | 7/1977 | Morris et al. |
| 4,077,228 | A | | 3/1978 | Schumacher et al. |
| 4,117,697 | A | | 10/1978 | Myers et al. |
| 4,124,996 | A | | 11/1978 | Kennedy et al. |
| 4,161,868 | A | | 7/1979 | Kennedy et al. |
| 4,344,291 | A | | 8/1982 | Tyree, Jr. et al. |
| 4,402,192 | A | | 9/1983 | Henry |
| 5,826,432 | A | | 10/1998 | Ledbetter |
| 6,128,911 | A | | 10/2000 | Mathews et al. |
| 6,536,064 | B1 | | 3/2003 | Swink et al. |

FOREIGN PATENT DOCUMENTS

| | | |
|---|---|---|
| EP | 0 117 043 | 8/1984 |
| GB | 943 675 | 12/1963 |
| JP | 406123536 | 5/1994 |

* cited by examiner

*Primary Examiner*—William E. Tapolcai
(74) *Attorney, Agent, or Firm*—Michael Best & Friedrich LLP

(57) ABSTRACT

A refrigerated display case including a case having rear and bottom walls that are coupled together to at least partially define a product display area adapted to receive a wheeled cart containing food product. The bottom wall includes a cart support surface elevated above the floor and adapted to support the wheeled cart within the product display area. The case includes an air passageway having a lower return flue located below the cart support surface. A refrigeration component is at least partially located in the air passageway to cool air directed to the product display area to maintain the products at the desired temperature. At least a portion of the cooled air in the product display area returns to the refrigeration component through the lower return flue.

20 Claims, 9 Drawing Sheets

OPEN-FRONT, ROLL-IN REFRIGERATED DISPLAY CASE

CROSS-REFERENCE TO RELATED APPLICATIONS

This application claims priority to U.S. Provisional Application No. 60/573,809, filed May 24, 2004, the entire contents of which is hereby incorporated by reference herein.

BACKGROUND

The invention relates to refrigerated display cases for retail applications and, more particularly, to open-front, roll-in refrigerated display cases.

Open-front refrigerated display cases typically require food product to be manually loaded onto the shelves within the case. Food products are delivered to the display case on movable carts and manually loaded onto the shelves of the case from the front side of the case. In an effort to reduce handling costs, it is beneficial to have an open-front, roll-in refrigerated display case that readily accepts movable carts that can be rolled into the display case.

Existing roll-in case designs exist in both front and rear loading configurations where carts are rolled into the refrigerated envelope at floor level from the front or back, respectively. The cart is then positioned adjacent the open-front so that consumers may remove product directly from the shelves on the cart.

Roll-in designs present challenges at the return air section of the case. Open-front refrigerated display cases require a means of air return, which is typically located along the lower section of the open face. Some roll-in return air designs include separate and distinct rectangular ducts that extend from the rear of the case out to the front of the cart. The ducts fit under the carts and between the respective rollers or wheels of the carts. The problem with this design is that the duct size and duct locations dictate specific cart sizes to be used with the case.

Another practice used by open-front, roll-in cases has been to locate the return air flue below ground level. The problem with this design is the added cost of installation needed to modify the floor below the refrigerated case.

Other front roll-in designs use removable lower front wall sections that assist to direct the return air under the cart through the passage created between the cart base and the floor surface.

Another design concept widely used in retail stores is a case that accepts movable carts loaded from the rear of the case. In this design, the case must be positioned adjacent to an opening within a storage cooler. This design takes cooled air from the cooler and cools it further before discharging it into the refrigerated envelope. Typically, a return air fan assembly is located at the bottom of the open face and returns the air back to the cooler. The opening at the rear of the case is sectioned from the storage cooler by a movable curtain. The problem with this design is that it requires a storage cooler adjacent to the case.

SUMMARY

The present invention is directed to an open-front, roll-in refrigerated display case that accepts a variety of cart sizes, permits the use of standard carts, permits easy access to the lower most parts of the cabinet and the floor for cleaning, does not require modifications to the floor, and does not require coupling to a storage cooler.

The open-front, roll-in refrigerated display case of the present invention includes a cart surface that is elevated from the floor. The cart surface partially defines a full-length return flue between the surface of the floor and the cart surface. The return flue communicates between the vertical rear passageway and a front passageway defined at least in part by a front panel.

The front panel is lightweight and removable to expose a ramp and the platform from the front side of the case. With the front panel removed, the ramp can be extended to allow the cart to be rolled up onto the platform. After the cart is within the case, the ramp is retracted and the front section is replaced. In some embodiments, the front passageway is defined by the front section and the retracted ramp. The cart surface and ramp are both movable to allow access to the floor for cleaning.

In one embodiment, the invention provides a refrigerated display case including a case having rear and bottom walls that are coupled together to at least partially define a product display area adapted to receive a wheeled cart containing food product. The bottom wall includes a cart support surface elevated above the floor and adapted to support the wheeled cart within the product display area. The case includes an air passageway having a lower return flue located below the cart support surface. A refrigeration component is at least partially located in the air passageway to cool air directed to the product display area to maintain the products at the desired temperature. At least a portion of the cooled air in the product display area returns to the refrigeration component through the lower return flue.

In other embodiments, the refrigerated display case of the present invention also includes a ramp coupled to the case and movable between a stored position and an operating position adapted to form a bridge between the floor and the cart surface. In yet other embodiments, the refrigerated display case also includes a front panel removably connected to the case. The front panel includes a vertical passageway in fluid communication between the product display area and the lower return flue. The vertical passageway is at least partially defined by the front panel and the ramp in the stored position.

In another embodiment, the invention provides a method for positioning a wheeled cart of food product into a refrigerated display case adapted for use on a shopping floor of a retail store. The method includes receiving the wheeled cart into a product display area, elevating the wheeled cart above the floor onto a cart support surface of a bottom wall, supporting the wheeled cart on the cart support surface within the product display area, displaying the food product on the wheeled cart, providing access to the food product from the exterior of the case, cooling air with a refrigeration component at least partially located in the air passageway, directing the cooled air to the product display area through an outlet, maintaining the food product at the desired temperature with the cooled air when the wheeled cart is received within the product display area, and returning at least a portion of the cooled air in the product display area to the refrigeration component through an inlet and a lower return flue.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

An open-front, roll-in refrigerated display case 10 according to one embodiment of the present invention is illustrated in FIGS. 1-8. The case 10 includes two separable, modular units 12 connected together along a common boundary 16 in a conventional manner. By this construction, the case 10 can be built to a variety of different sizes by using any desired number of repeatable modular units 12. For purposes of clarity, the structure and operation of a single unit 12 of the case 10 will be described below.

Figure 1:
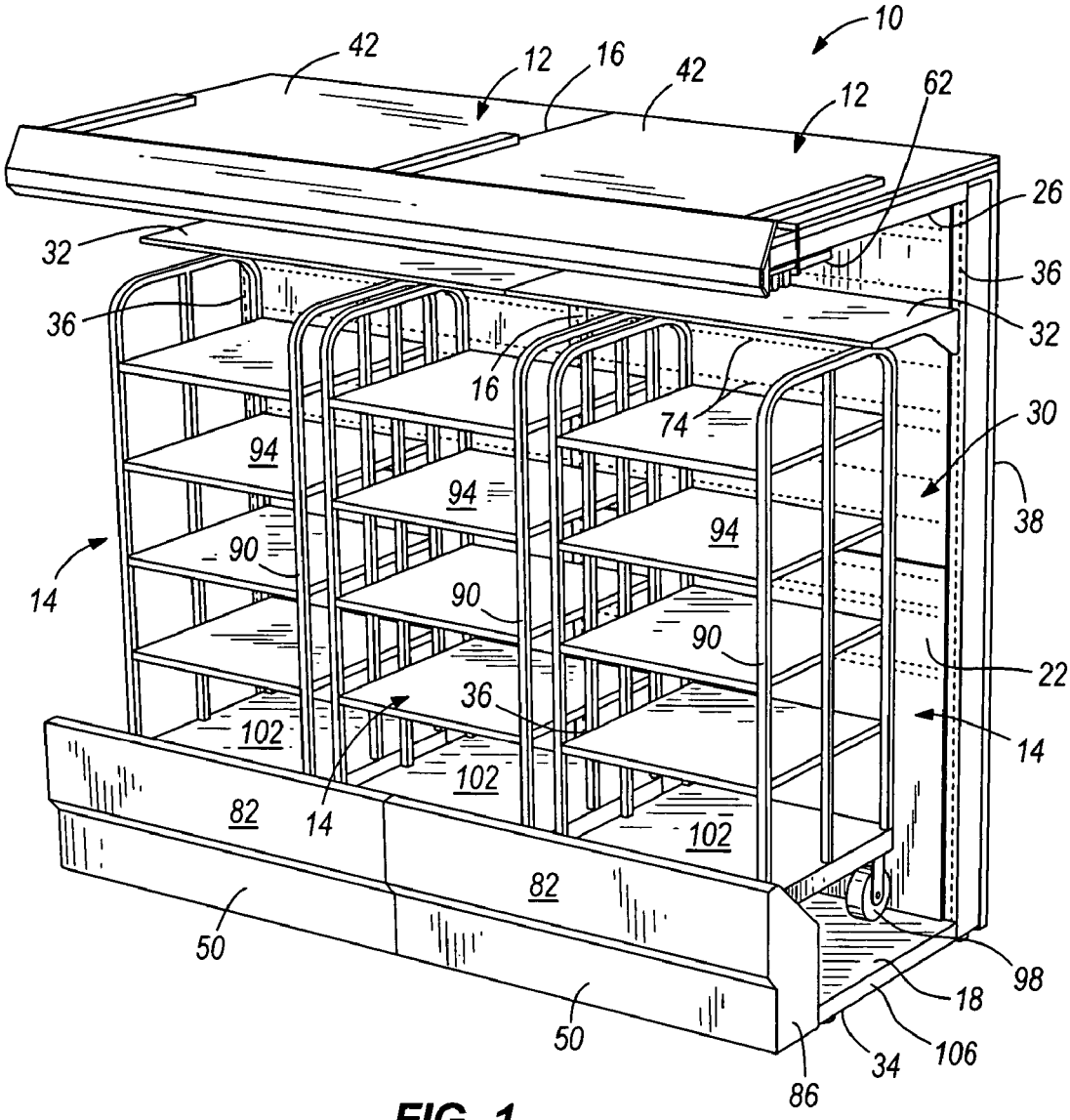
FIG. 1 is a front perspective view of an open-front, roll-in refrigerated display case embodying the present invention.
Figure 2:
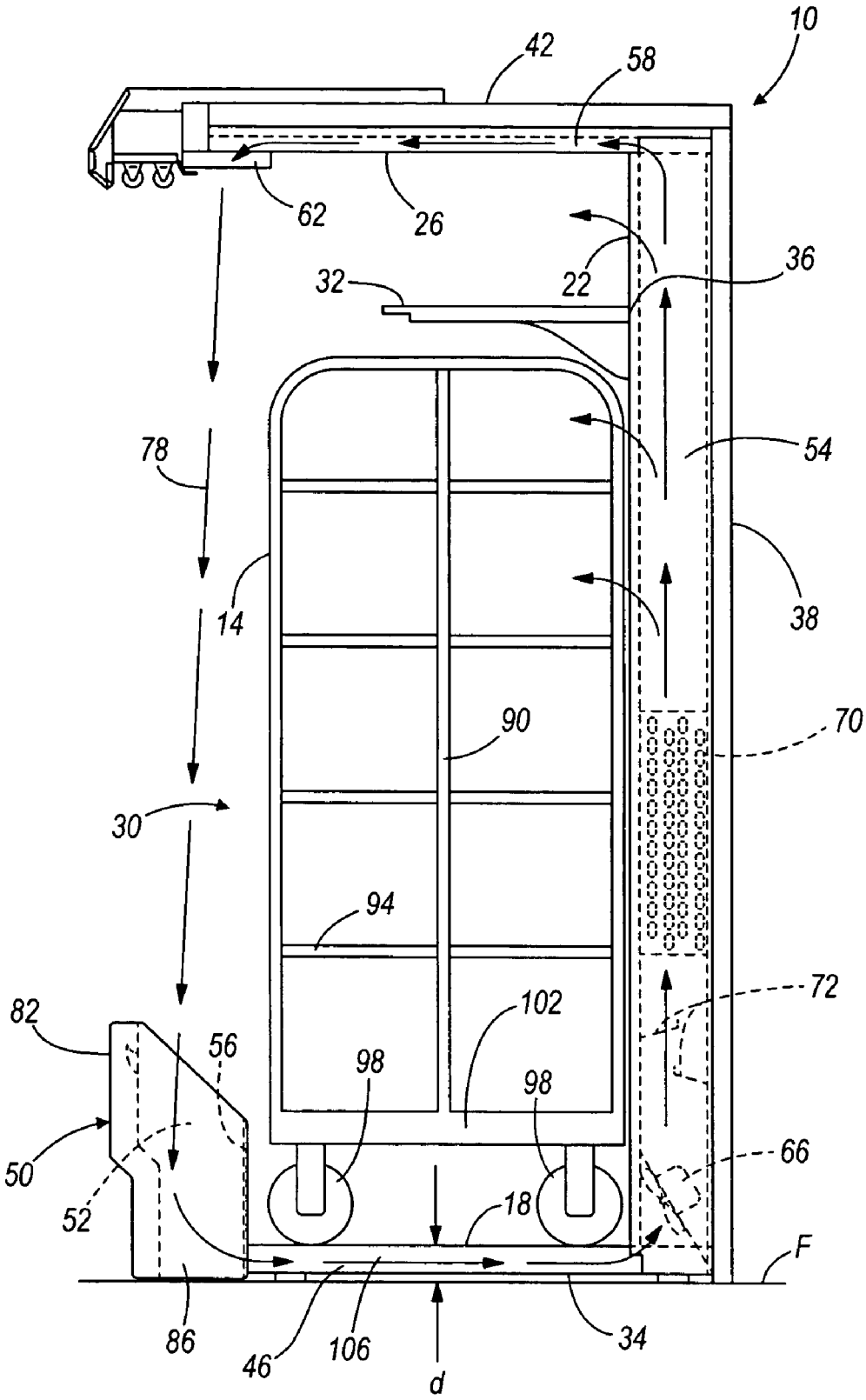
FIG. 2 is a side view of the case shown in FIG. 1.

With reference to FIGS. 1 and 2, the case 10 includes an interior bottom wall or cart surface 18, an interior rear wall 22, and an interior top wall 26. The cart surface 18 is elevated a distance "d" above the surface of the floor F (FIG. 2). The area bounded by the cart surface 18, interior rear wall 22, and the interior top wall 26 defines a product display area 30. The product display area 30 includes shelves 32 and carts 14 supported by the cart surface 18. The case 10 includes an open front face to allow customers access to the fresh food and/or beverages stored in the case 10. The shelves 32 are supported at the ends by shelf support rails 36 of the case 10 (see also FIG. 1). The number of shelves 32 used is variable and only limited by the size of the carts 14 positioned within the case 10.

The case 10 also generally defines a base or exterior bottom wall 34 adjacent the cart surface 18, an exterior rear wall 38 adjacent the interior rear wall 22, and an exterior top wall 42 adjacent the interior top wall 26. A lower return flue 46 is defined between the cart surface 18 and exterior bottom wall 34 to allow for substantially horizontal airflow throughout the lower flue 46. In other embodiments, the lower return flue 46 is defined between the cart surface 18 and the surface of the floor F, with no exterior bottom wall in between.

With reference to FIGS. 1 and 2, the case 10 includes a removable front panel 50 along the lower front portion of the case 10. The front panel 50 includes an upwardly-opening vertical passageway 52 (see FIG. 2) and is removably coupled to the case 10 such that the vertical passageway 52 communicates with the lower return flue 46 to allow air from the product display area 30 to be drawn into the lower flue 46. The front panel 50 can be a blow-molded, hollow, impact-resistant piece made from a lightweight polymer. The front panel 50 can easily connect to and disconnect from the lower return flue 46 by mating channels, quick-release fasteners, or other means of connection. For example, the front panel 50 can include formed holes that receive vertically-extending pins located on frame members 106 of the case 10. The front panel 50 can be removed from the case 10 by lifting the front panel 50 off of the pins.

Figure 3:
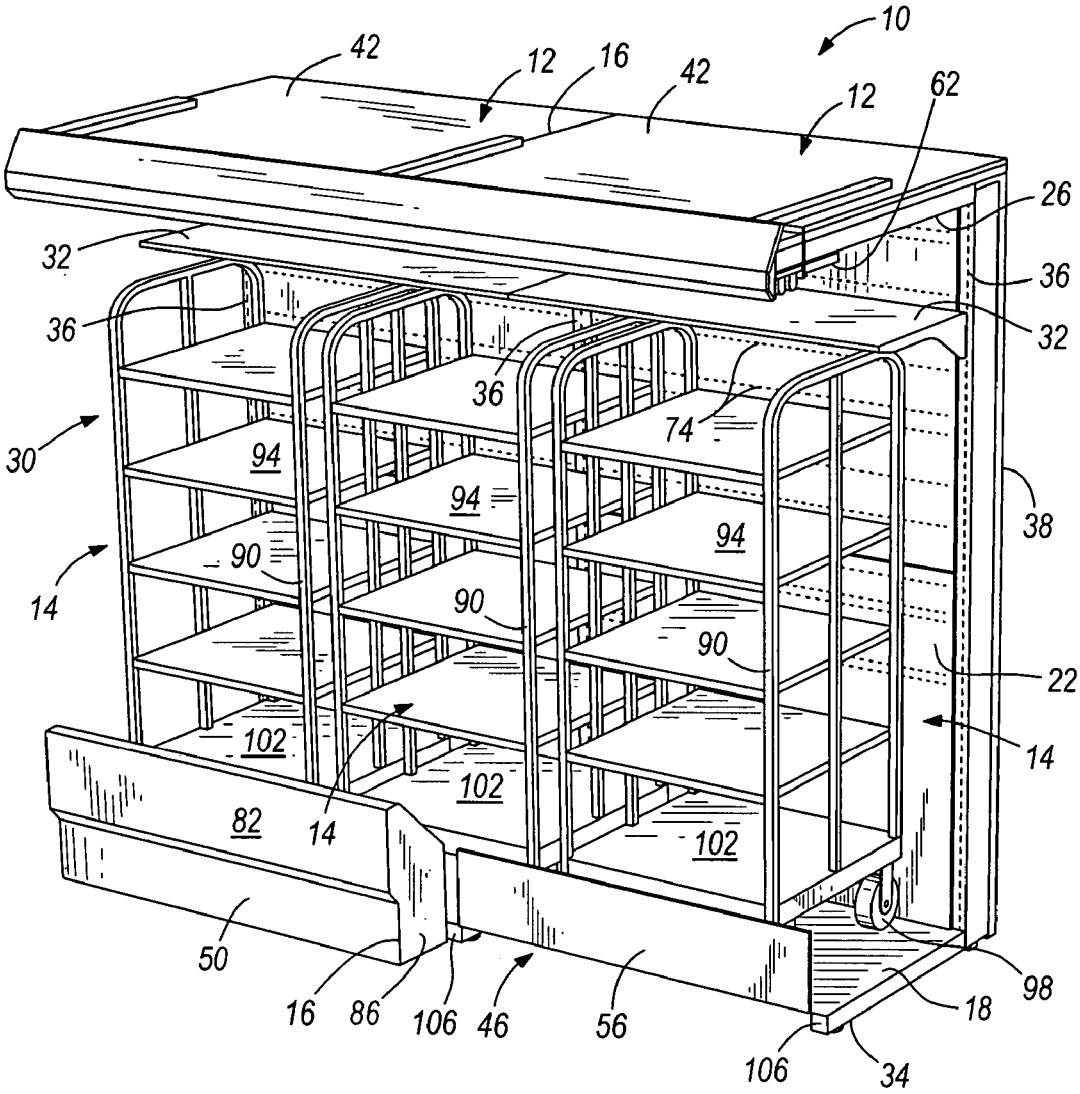
FIG. 3 is a view similar to FIG. 1 illustrating the case with a front panel removed and a ramp in the stored position.
Figure 4:
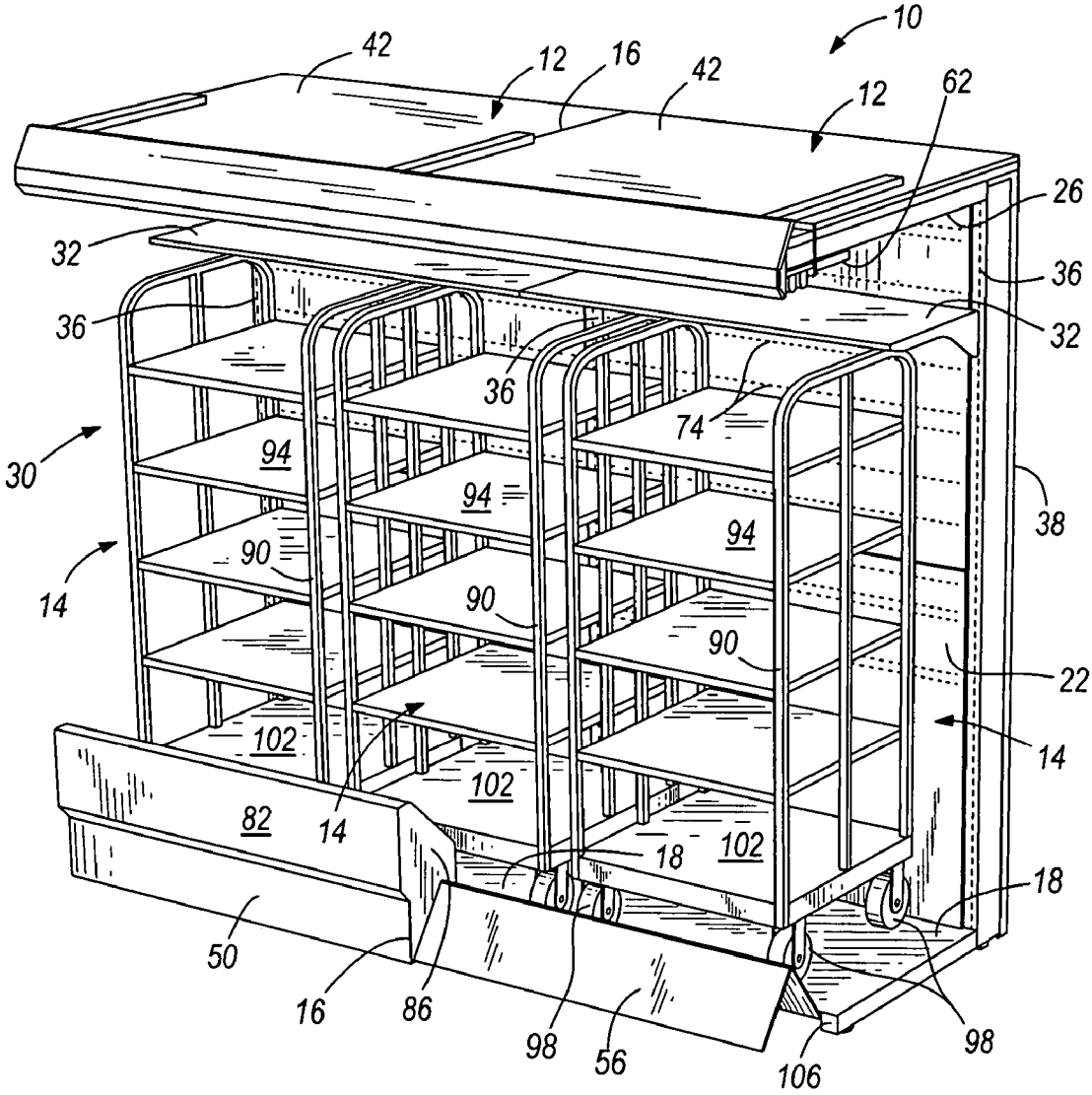
FIG. 4 is a view similar to FIG. 3 illustrating the case with the ramp being extended.
Figure 9:
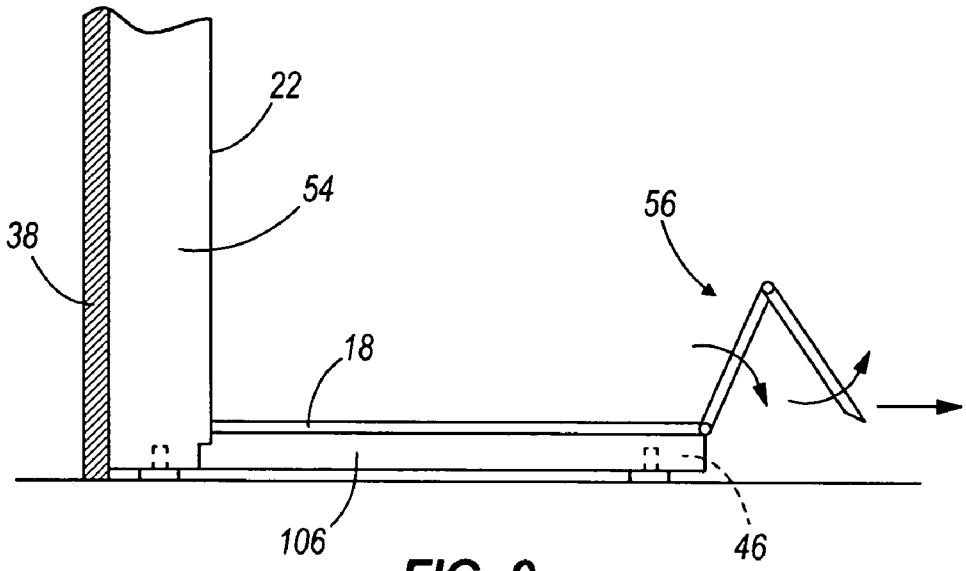
FIG. 9 is a side view of the case shown in FIG. 1 illustrating one construction of the ramp.

With reference to FIGS. 2 and 3, the case 10 also includes a ramp 56 pivotally connected to the case 10 for movement between a retracted, stored position and an extended, operating position. In the operating position, the ramp 56 forms a bridge between the floor F and the cart surface 18 allowing the carts 14 to be rolled into the product display area 30 directly from the floor F. As shown in FIGS. 4 and 9, the ramp 56 is hinged at its center and folded over to form a vertically-oriented plate in the stored position. In this position, the ramp 56 partially defines the vertical passageway 52 in cooperation with the front panel 50 (FIG. 2). Specifically, the front panel 50 includes a front portion 82 and side portions 86 to define a U-shaped cross-section. The side portions 86 couple with the ramp 56 in the stored position to complete the vertical passageway 52. In some embodiments, the bottoms of the front and side portions 82, 86 sealingly engage the floor F to resist leakage of air therethrough. In some embodiments, the front portion 82 can include two pivoting doors that are hinged at their outer edges to the side portions 86. The doors can include a latch or lock on the interior side to allow the doors to be selectively connected. When unlatched, the doors can pivot outwardly about the hinges to expose the ramp 56.

Figure 10:
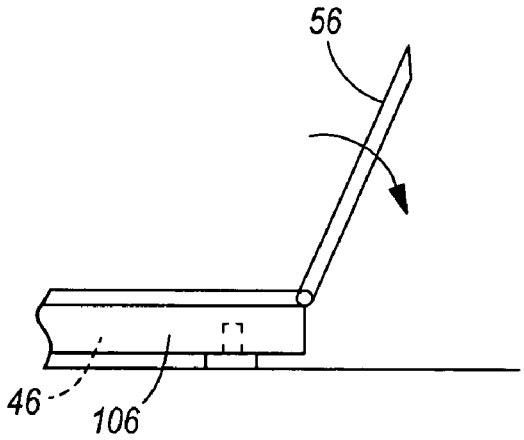
FIG. 10 is a side view similar to FIG. 9 illustrating another construction of the ramp.
Figure 11:
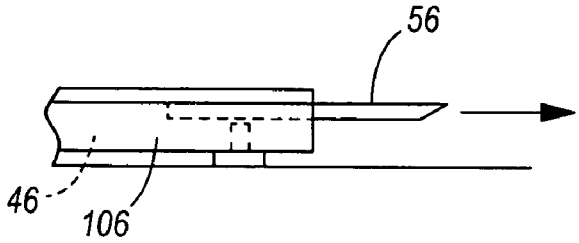
FIG. 11 is a side view similar to FIG. 10 illustrating yet another construction of the ramp.

In other embodiments, the ramp 56 can be constructed to move between different stored and operating positions. For example, in FIG. 10 the ramp 56 is a single plate that is only hinged at one end to the case 10 and pivotable between the stored and operating positions. As another example, in FIG. 11 the ramp 56 is slidably coupled to the case 10 and moved between a stored positioned within the lower return flue 46 and an operating position removed from the flue 46 and exposed on the front of the case 10.

With reference to FIG. 2, a rear flue 54 is defined between the interior and exterior rear walls 22, 38 and is fluidly connected with and adjacent to the lower return flue 46. The rear flue 54 allows for substantially vertical airflow throughout the rear flue 54. In some embodiments, the bottom of the exterior rear wall 38 sealingly engages the floor F to resist leakage of air therethrough.

An upper flue 58 is defined between the interior and exterior top walls 26, 42 and is fluidly connected with and adjacent to the rear flue 54. The upper flue 58 allows for substantially horizontal airflow throughout the upper flue 58. The interior top wall 26 includes an opening 62 to allow airflow in the upper flue 58 to be discharged from the upper flue 58 and into the product display area 30. When combined, the front panel 50, the lower flue 46, the rear flue 54, and the upper flue 58 comprise an air passage separate from the product display area 30.

With continued reference to FIG. 2, the case 10 also includes some components of a refrigeration system (not entirely shown) therein. One or more fans 66 are located within the rear flue 54 to generate an airflow through the air passage. An evaporator 70 is located within the rear flue 54 downstream of the fans 66 such that the airflow generated by the fans 66 passes through the evaporator 70. The fans 66 may also be positioned upstream of the evaporator 70. The refrigeration system may also include other components (not shown), such as one or more compressors, one or more condensers, a receiver, and one or more expansion valves, all of which may be remotely located from the case 10.

The evaporator 70 is configured to receive a liquid refrigerant from the receiver. As is known in the art, the liquid refrigerant is evaporated as it passes through the evaporator 70 as a result of absorbing heat from the airflow passing through the evaporator 70. Consequently, the temperature of the airflow passing through the evaporator 70 decreases as it passes through the evaporator 70. The heated, or gaseous refrigerant then exits the evaporator 70 and is pumped back to the remotely located compressor(s) for re-processing into the refrigeration system.

The evaporator 70 can be a conventional round-tube plate-fin evaporator, a flat-tube evaporator, or a micro-channel evaporator. As used herein, the evaporator 70 is not limited to using a two-phase refrigerant, such as ammonia. Further, the evaporator 70 can also be used as a heat exchanger using a single-phase refrigerant, such as glycol, to absorb heat from the airflow passing through the evaporator 70. The evaporator 70 can be a single evaporator extending the length of the case 10 or it can be multiple modular evaporators that are connected together to extend the length of the case 10 as described in U.S. Reissue Pat. No. RE37,630 (Entitled REFRIGERATED MERCHANDISER WITH MODULAR EVAPORATOR COILS AND EEPR CONTROL).

The rear flue 54 includes drain troughs 72 that collect condensate that drips from the evaporator 70 during normal or defrost operations. The drain toughs 72 are angled to direct the collected condensate to flow in a specified direction toward a proper drain. The drain troughs 72 are divided to create a central gap that allows the airflow from the fans 66 to reach the evaporator 70 unobstructed.

The interior rear wall 22 can include a plurality of apertures 74 (see FIG. 1) formed therein. The apertures 74 fluidly connect the product display area 30 and the rear flue 54. The apertures 74 allow some of the refrigerated airflow in the rear flue 54 to exit the rear flue 54 and enter the product display area 30. Products located in the product display area 30 may then be cooled by the refrigerated airflow.

The refrigerated airflow that does not pass through the apertures 74 is routed vertically through the rear flue 54, and horizontally through the upper flue 58 before being discharged from the upper flue 58 via the opening 62 in the interior top wall 26. After being discharged from the opening 62 in the interior top wall 26, the refrigerated airflow moves downwardly along the open front face of the case 10 before being drawn back into the front panel 50 for re-use by the fans 66. This portion of the refrigerated airflow is known in the art as an air curtain 78 (see FIG. 2). The air curtain 78, among other things, helps maintain the air temperature in the product display area 30 within a desired temperature range.

Carts 14 are typically filled with products at a distributor and delivered to a retail store where the carts 14 are stocked in a storage cooler typically located in a back room of the store. These carts 14 are used to supply the case 10 with additional products when the supply has been depleted. The cart 14 includes a frame 90, multiple shelves 94 connected to the frame 90, and casters or wheels 98 connected to a base 102 of the frame 90. The wheels 94 allow the cart 14 and products supported on the shelves 94 to be conveniently rolled between the various locations.

Figure 5:
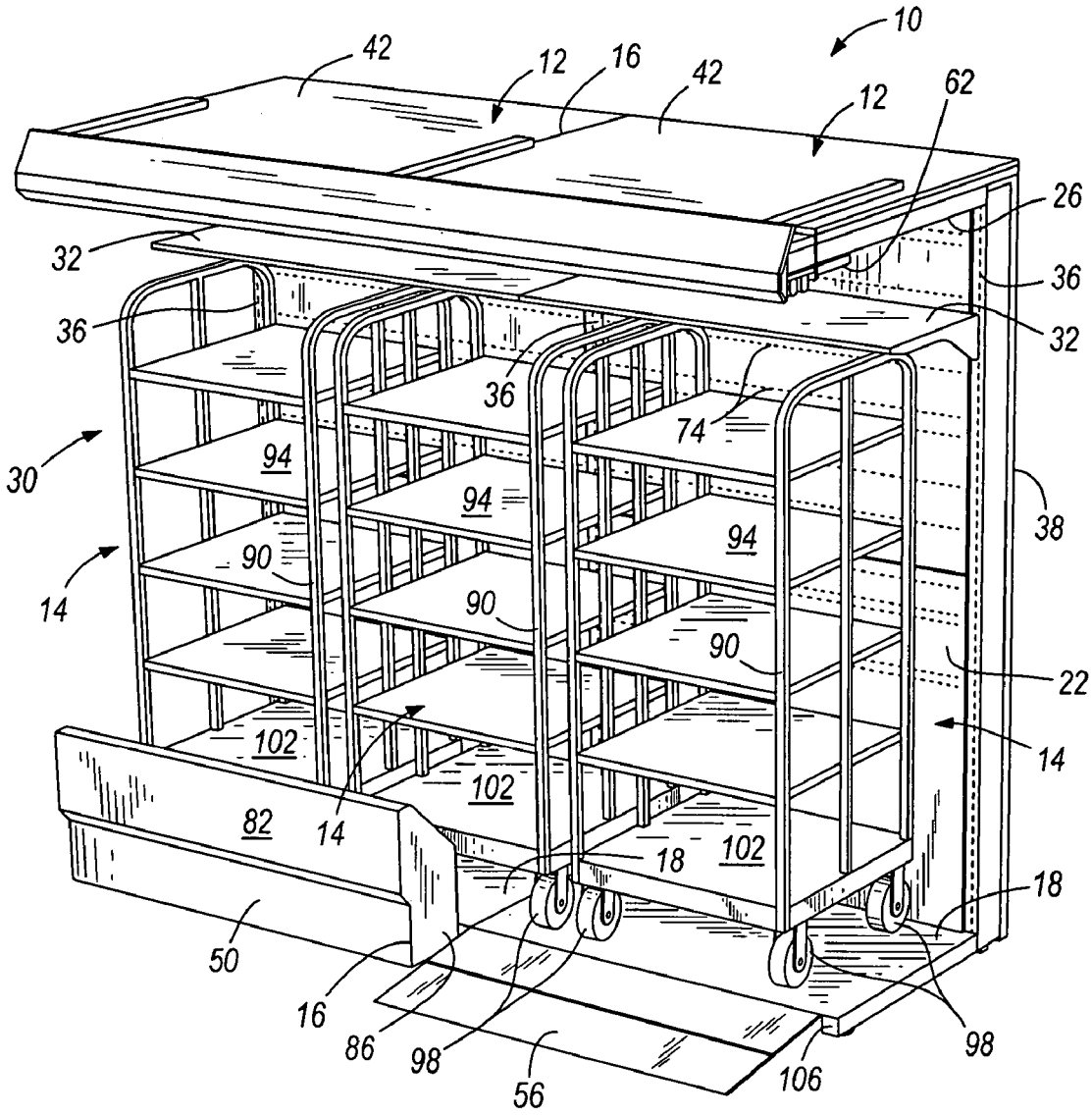
FIG. 5 is a view similar to FIG. 3 illustrating the case with the ramp in the operating position.
Figure 6:
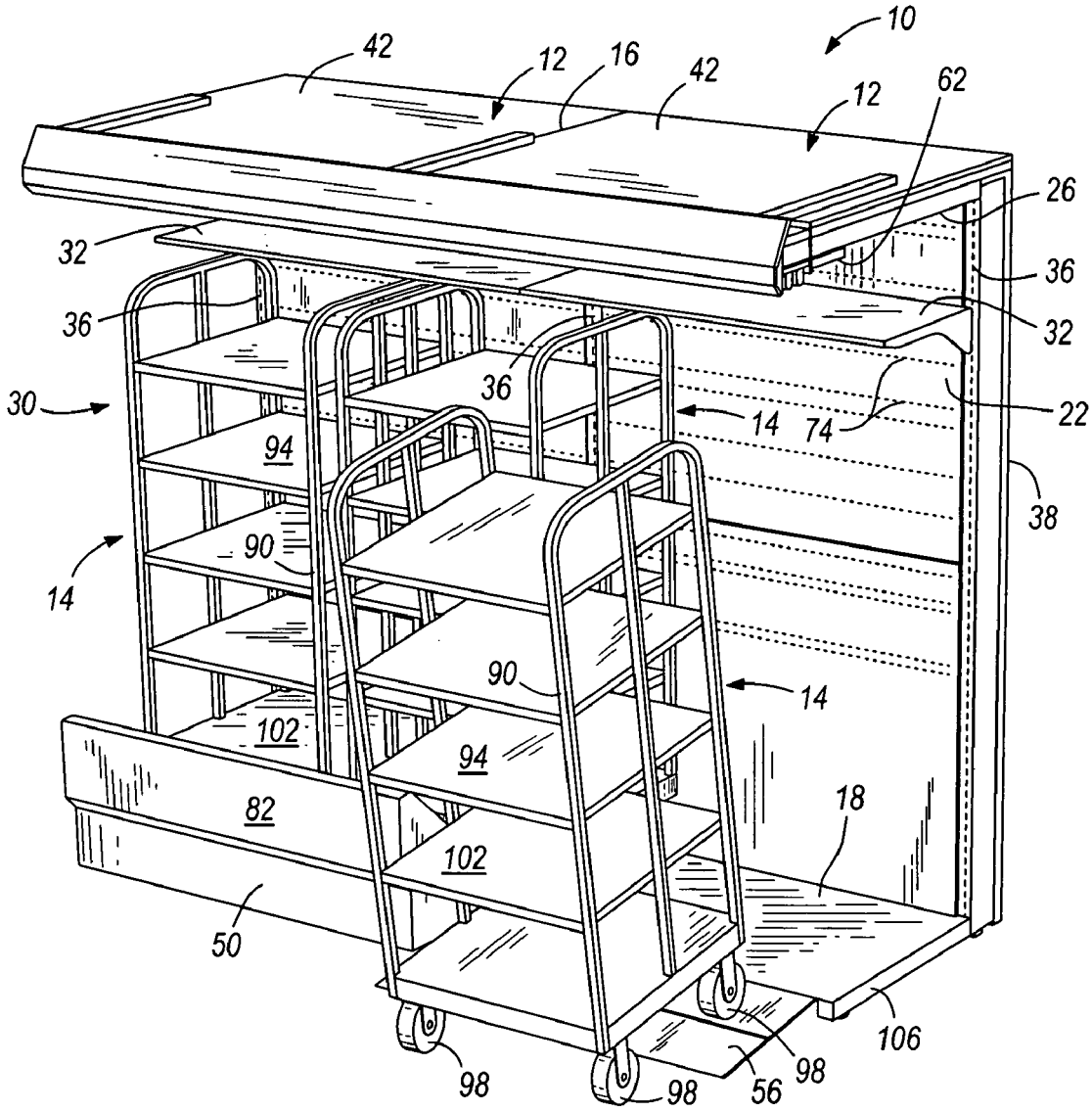
FIG. 6 is a view similar to FIG. 3 illustrating the case with a cart being rolled down the ramp and out of the case.

The removal of the cart 14 from the case 10 is described below with reference to FIGS. 1-8. First, the front panel 50 is uncoupled from the case 10 and removed from the case 10 thereby exposing the ramp 56 in the stored position (FIG. 3). Next, the ramp 56 is unfolded and extended to the operating position in which the ramp 56 extends between the floor F to the cart surface 18 (FIGS. 4 and 5). The cart 14 is then rolled out of the product display area 30, across the extended ramp 56, and onto the floor F in front of the case 10 (FIG. 6).

Figure 7:
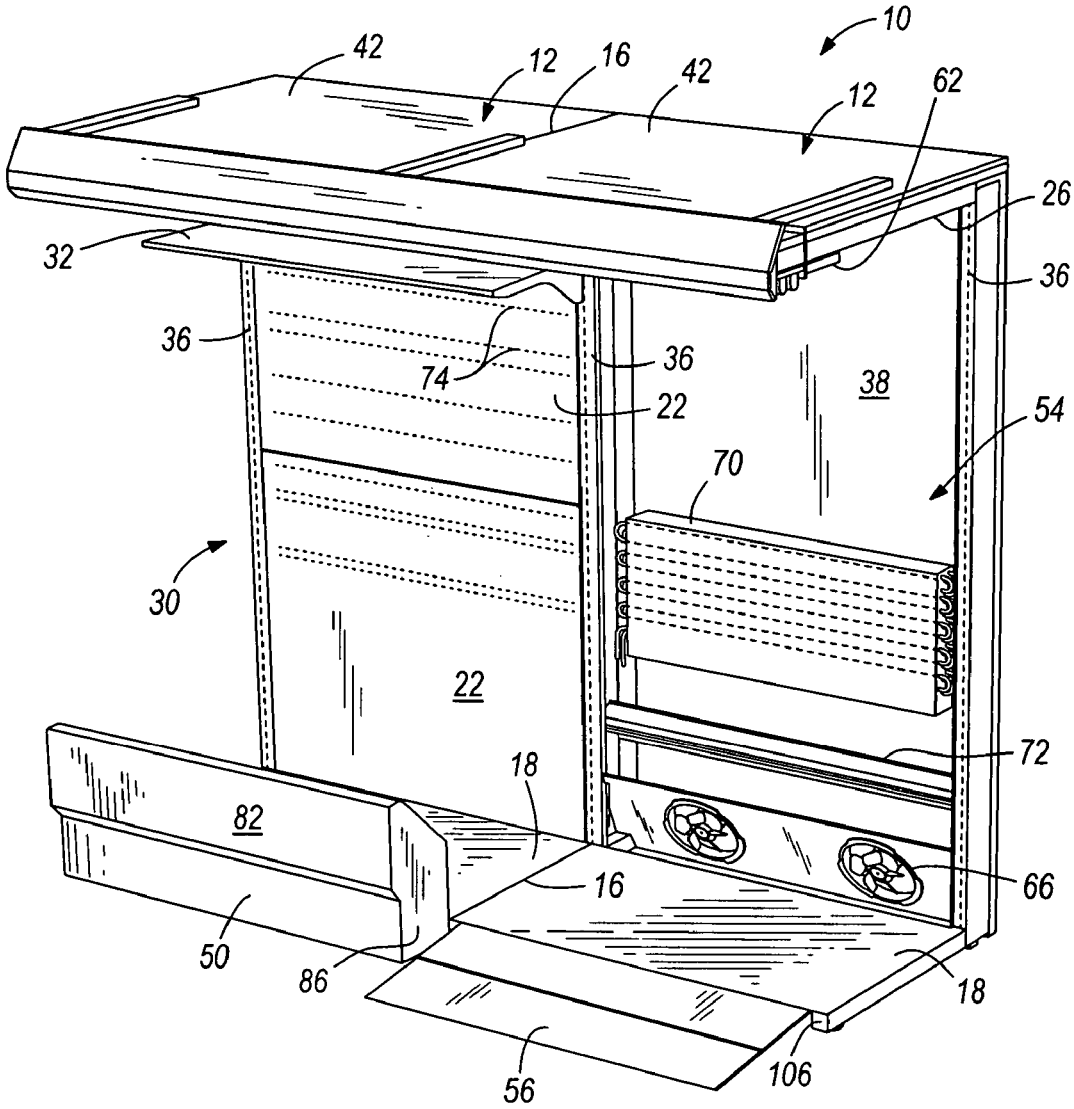
FIG. 7 is a view similar to FIG. 6 illustrating the case with the carts removed and an interior rear panel removed.
Figure 8:
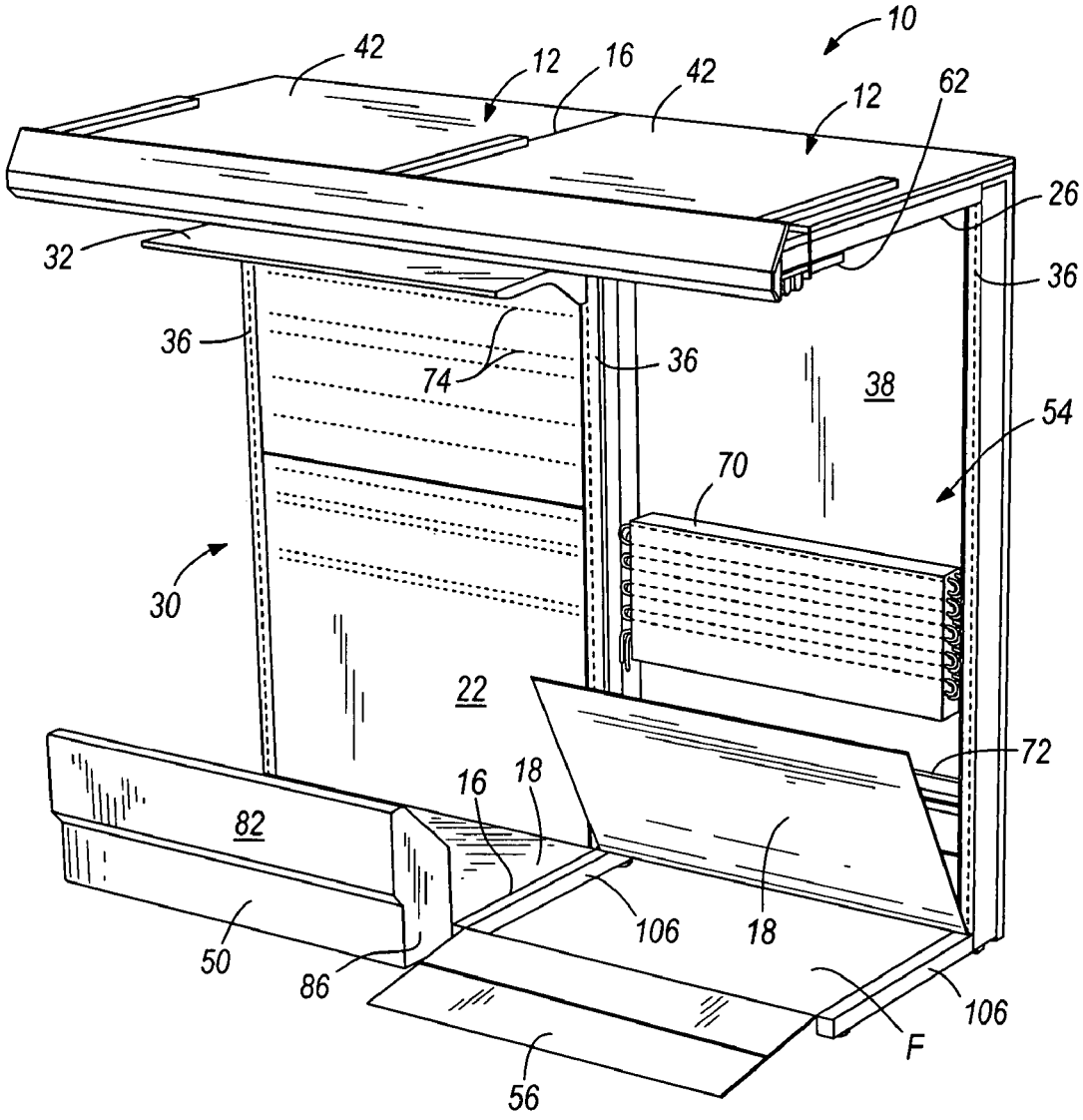
FIG. 8 is a view similar to FIG. 7 illustrating the case with a cart surface in an elevated position.

With the cart 14 removed, access can be obtained to the rear flue 54 by removing the interior rear wall 22. As best shown in FIG. 7, when the rear wall 22 is removed, the evaporator 70, the drain trough 72, and the fans 66 are exposed for cleaning and maintenance. In addition, as shown in FIG. 8, the cart surface 18 can be pivoted upwardly to expose the base of the lower return flue 46 for cleaning. As discussed above, the base of the lower return flue 46 can be either an exterior bottom wall 34 connected to the case 10 or it could simply be defined by the floor F. FIG. 8 also shows that the cart surface 18 is supported by forwardly extending frame members 106. More than two frame members 106 may also be used to support the cart surface 18.

To restock the case 10 with a replacement cart (not shown) full of products, the replacement cart is rolled into position in front of the extended ramp 56. The replacement cart is then pushed into the product display area 30 adjacent to the interior rear wall 22. The ramp 56 is then raised and folded into its stored position and the front panel 50 is re-attached to the case 10. After the front panel 50 is replaced, the air passageway is restored to correctly circulate the airflow and maintain the desired temperature in the product display area 30.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

Various features and advantages of the invention are set forth in the following claims.

What is claimed is:

1. A refrigerated display case adapted for use on a shopping floor of a retail store, the refrigerated display case adapted to receive at least one wheeled cart having food product, the refrigerated display case comprising:

a case having a rear wall and a bottom wall coupled together to at least partially define a product display area adapted to receive the wheeled cart and display and provide access to the food product from the exterior of the case, the bottom wall including a cart support surface elevated above the floor and adapted to support the wheeled cart within the product display area, and an air passageway having an inlet and outlet in fluid communication with the product display area, the air passageway having a lower return flue in fluid communication with the inlet, at least partially defined by the bottom wall, and located below the cart support surface, the air passageway also having a rear flue in fluid communication between the lower return flue and the outlet, the rear flue at least partially defined by the rear wall;

a refrigeration component at least partially located in the air passageway to cool air directed to the product display area through the outlet, the cooled air provided to maintain the food product at the desired temperature when the wheeled cart is received within the product display area, at least a portion of the cooled air in the product display area returning to the refrigeration component through the inlet and the lower return flue; and a ramp coupled to the case and movable between a stored position and an operating position adapted to form a bridge between the floor and the cart surface, the ramp including a first plate pivotably coupled at one end to the cart support surface, and a second plate pivotably coupled to the opposite end of the first plate.

2. The refrigerated display case of claim 1, wherein the first and second plates are substantially parallel to each other and substantially vertical when the ramp is in the stored position.

3. The refrigerated display case of claim 2, wherein the first and second plates are substantially aligned with each other when the ramp is in the operating position.

4. The refrigerated display case of claim 1, further comprising a front panel removably connected to the case, the front panel at least partially defining the inlet.

5. The refrigerated display case of claim 4, wherein the air passageway includes a vertical passageway in fluid communication between the inlet and the lower return flue, the vertical passageway at least partially defined by the front panel.

6. The refrigerated display case of claim 5, further comprising a ramp coupled to the case and movable between a stored position and an operating position adapted to form a bridge between the floor and the cart surface, the ramp in the stored position at least partially defining the vertical passageway.

7. The refrigerated display case of claim 5, wherein the front panel is a blow molded, hollow material.

8. The refrigerated display case of claim 7, wherein the front panel is an impact resistant, lightweight polymer.

9. The refrigerated display case of claim 1, wherein the lower return flue is located between the cart support surface and the floor.

10. The refrigerated display case of claim 1, wherein bottom wall includes an exterior bottom wall spaced apart from the cart support surface and above the floor, the lower return flue being located between the cart support surface and the exterior bottom wall.

11. A method for positioning a wheeled cart of food product into a refrigerated display case adapted for use on a shopping floor of a retail store, the method comprising:

providing a case having a rear wall and a bottom wall coupled together to define a product display area;

providing an air passageway having an inlet and outlet in fluid communication with the product display area, the air passageway having a lower return flue in fluid communication with the inlet, at least partially defined by the bottom wall, and located below the cart support surface, the air passageway also having a rear flue in fluid communication between the lower return flue and the outlet, the rear flue at least partially defined by the rear wall;

receiving the wheeled cart into the product display area;

elevating the wheeled cart above the floor onto a cart support surface of the bottom wall;

supporting the wheeled cart on the cart support surface within the product display area;

displaying the food product on the wheeled cart;

providing access to the food product from the exterior of the case;

cooling air with a refrigeration component at least partially located in the air passageway;

directing the cooled air to the product display area through the outlet;

maintaining the food product at the desired temperature with the cooled air when the wheeled cart is received within the product display area;

at least partially defining a vertical passageway with a front panel;

at least partially defining the vertical passageway with a ramp coupled to the case; and returning at least a portion of the cooled air in the product display area to the refrigeration component through the inlet and the lower return flue.

12. The method of claim 11, further comprising moving a ramp from a stored position to an operating position, and forming a bridge between the floor and the cart surface with the ramp in the operating position.

13. The method of claim 12, wherein elevating the wheeled cart includes rolling the wheeled cart up the ramp from the floor and onto the cart support surface.

14. The method of claim 11, further comprising at least partially defining the inlet with a front panel, removing the front panel from the case, and exposing a ramp in a stored position.

15. A refrigerated display case adapted for use on a shopping floor of a retail store, the refrigerated display case adapted to receive at least one wheeled cart having food product, the refrigerated display case comprising:

a case having a rear wall and a bottom wall coupled together to at least partially define a product display area adapted to receive the wheeled cart and display and provide access to the food product from the exterior of the case, the bottom wall including a cart support surface elevated above the floor and adapted to support the wheeled cart within the product display area, and an air passageway having an inlet and outlet in fluid communication with the product display area, the inlet at least partially defined by a front panel removably coupled to the case, the air passageway having a lower return flue in fluid communication with the inlet, at least partially defined by the bottom wall, and located below the cart support surface, the air passageway also having a rear flue in fluid communication between the lower return flue and the outlet, the rear flue at least partially defined by the rear wall;

a ramp coupled to the case and movable between a stored position and an operating position adapted to form a bridge between the floor and the cart surface, the ramp being exposed in the stored position when the front panel is removed from the case; and a refrigeration component at least partially located in the air passageway to cool air directed to the product display area through the outlet, the cooled air provided to maintain the food product at the desired temperature when the wheeled cart is received within the product display area, at least a portion of the cooled air in the product display area returning to the refrigeration component through the inlet and the lower return flue.

16. A method for positioning a wheeled cart of food product into a refrigerated display case adapted for use on a shopping floor of a retail store, the method comprising:

providing a case having a rear wall and a bottom wall coupled together to define a product display area;

providing an air passageway having an inlet and outlet in fluid communication with the product display area, the air passageway having a lower return flue in fluid communication with the inlet, at least partially defined by the bottom wall, and located below the cart support surface, the air passageway also having a rear flue in fluid communication between the lower return flue and the outlet, the rear flue at least partially defined by the rear wall;

receiving the wheeled cart into the product display area;

elevating the wheeled cart above the floor onto a cart support surface of the bottom wall;

supporting the wheeled cart on the cart support surface within the product display area;

displaying the food product on the wheeled cart;

providing access to the food product from the exterior of the case;

cooling air with a refrigeration component at least partially located in the air passageway;

directing the cooled air to the product display area through the outlet;

maintaining the food product at the desired temperature with the cooled air when the wheeled cart is received within the product display area at least partially defining the inlet with a front panel;

removing the front panel from the case and exposing a ramp in a stored position; and returning at least a portion of the cooled air in the product display area to the refrigeration component through the inlet and the lower return flue.

17. The method of claim 16, further comprising moving the ramp from the stored position to an operating position, and forming a bridge between the floor and the cart support surface with the ramp in the operating position.

18. The method of claim 17, wherein elevating the wheeled cart includes rolling the wheeled cart up the ramp from the floor and onto the cart support surface.

19. The method of claim 16, further comprising at least partially defining a vertical passageway with a front panel.

20. The method of claim 19, further comprising at least partially defining the vertical passageway with a ramp coupled to the case.

* * * * *